United States Patent [19]

Haus, Jr. et al.

[11] 4,313,319

[45] Feb. 2, 1982

[54] LOCK AND KEY COMBINATION WITH MASTERING CONCEPT

[76] Inventors: Paul Z. Haus, Jr., 787 Hartwell St., Teaneck, N.J. 07666; John A. Signorelli, 2150 E. 29th St., Brooklyn, N.Y. 11229

[21] Appl. No.: 140,255

[22] Filed: Apr. 14, 1980

[51] Int. Cl.[3] ..... E05B 67/36

[52] U.S. Cl. ..... 70/34; 70/347; 70/409

[58] Field of Search ..... 70/32–34, 70/386, 346, 347, 409, 411

[56] References Cited

U.S. PATENT DOCUMENTS

| | | | |
|---|---|---|---|
| 1,923,025 | 8/1933 | Morse . | |
| 2,580,894 | 1/1952 | DeHoffmann | 70/346 |
| 2,721,470 | 10/1955 | Hensel | 70/346 |
| 3,002,368 | 10/1961 | Moberg . | |
| 3,033,016 | 5/1962 | Moberg . | |
| 3,478,548 | 11/1969 | Finck . | |
| 3,714,802 | 2/1972 | Morse . | |
| 3,835,674 | 9/1974 | Hoyt . | |
| 4,015,456 | 4/1977 | Moberg . | |
| 4,040,279 | 8/1977 | Signorelli . | |
| 4,058,992 | 11/1977 | Nielsen . | |
| 4,063,434 | 12/1977 | Moberg . | |
| 4,155,232 | 5/1979 | Haus . | |
| 4,193,276 | 3/1980 | Lundberg | 70/34 |

*Primary Examiner*—Robert L. Wolfe

*Attorney, Agent, or Firm*—Brooks, Haidt, Haffner & Delahunty

[57] ABSTRACT

A plunger type lock construction in which the key receiving face thereof is spaced a critical distance from a portion of a reciprocable plunger which is within the lock body and which is engaged by the key to release locking members extending from the lock body. The lock body has shaped means at its key receiving face which prevents insertion of a key to the proper, lock operating depth in the lock if the end of the key which faces the key receiving face is not shaped so as to receive the shaped means on the lock body. Each lock may have a differently shaped means so that a key which will fit one lock will not fit another lock, but a master key may be provided which will fit all or only a plurality, of such locks.

23 Claims, 25 Drawing Figures

LOCK AND KEY COMBINATION WITH MASTERING CONCEPT

The invention relates to plunger or barrel type locks and keys.

Locks having internal, spring-loaded, axially movable plungers and radially extending locking members, such as steel balls, are widely used to prevent tampering with gas and electric meters, current transformers and service entrances. Examples of such locks, generally called plunger-type locks throughout this specification, are shown in U.S. Pat. Nos. 1,923,025 and 3,714,802 to Morse et al; 3,002,368 and 3,033,016 to Moberg; 3,478,548 to Finck; 3,835,674 to Hoyt and 4,040,279 and 4,155,232 to Haus and Signorelli. The locks of all the foregoing patents are intended to prevent unlocking by any means other than the proper key.

A single key will open the locks of U.S. Pat. No. 4,040,279 installed on various pieces of equipment, and U.S. Pat. No. 4,155,232 discloses means for requiring different keys for opening locks of the same structure but with different dimensions. A number of different locks requiring different keys can be made without significantly modifying the locks and the keys. When each of a plurality of locks is designed to be opened only by one of a plurality of keys, it is possible to provide a single key which may be used as a master key to open a plurality of the different locks.

The loss or theft of a key exposes to unauthorized entry the many locks for which the key is intended, and despite vigilance in restricting access to keys, there have been cases in which keys have been unlawfully used. The security problem of lost and stolen keys has been difficult to combat because personnel are required to have keys for the locks, and control, record keeping and administration related to the keys has been difficult.

Furthermore, it is often desirable that locks installed on one type of equipment, or on equipment located in one area, not be openable by keys for locks installed on a plurality of other types of equipment or on equipment located in a plurality of different areas. For example, it may be desirable to have locks on equipment of one utility company which cannot be opened by keys used to open locks on equipment of another utility company.

One object of the invention is to provide plunger type locks of the same internal construction and each of a plurality of which requires a unique key for opening the lock.

Another object of the invention is to provide a unique key for each of the plurality of locks of the invention, each key having the same internal construction but having an external configuration which co-operates with the external configuration of the lock with which it is to be used to permit opening of such latter lock.

A further object of the invention is to provide plunger type locks each of which can be opened by not only a single key specifically designed to do so but also by a sub-master key which can also open a plurality of other locks and by a master key which can open all locks.

A still further object of the invention is to accomplish the objects of the invention set forth hereinbefore in an uncomplicated inexpensive manner.

In accordance with the presently preferred embodiment of the invention, the lock comprises the parts described in U.S. Pat. No. 4,155,232 modified to include a frangible connection between the piston and the cylinder member, as described in U.S. Pat. No. 4,040,279, and modified to include one or more raised rings at the key receiving end thereof. The key for the lock comprises the parts described in said U.S. Pat. No. 4,155,232 modified at the end thereof which engages the lock to include one or more recesses for receiving the raised rings on the end of the lock, whereby the operating member of the key extends to the proper depth in the lock when the lock rings are received within the recesses in the key.

In a modified form of the invention, the key receiving end of the lock has raised arcuate segments, rather than complete rings, and the key has corresponding recesses.

In a further modified embodiment of the invention, the key receiving end of the lock has an extension with one or more teeth extending radially outwardly or with recesses extending inwardly, and the key has one or more longitudinally extending recesses for receiving said teeth or one or more teeth for fitting into the recesses of the lock extension.

Other objects and advantages of the present invention will be apparent from the following detailed description of the presently preferred embodiments thereof, which description should be considered in conjunction with the accompanying drawings in which.

The invention will be described in conjunction with the use of the lock of the invention to secure the cover of a connection box on which a watthour meter is mounted, but it will be understood by those skilled in the art that the lock can be used for many other purposes including those applications in which plunger-type locks have been used previously.

Figure 1:
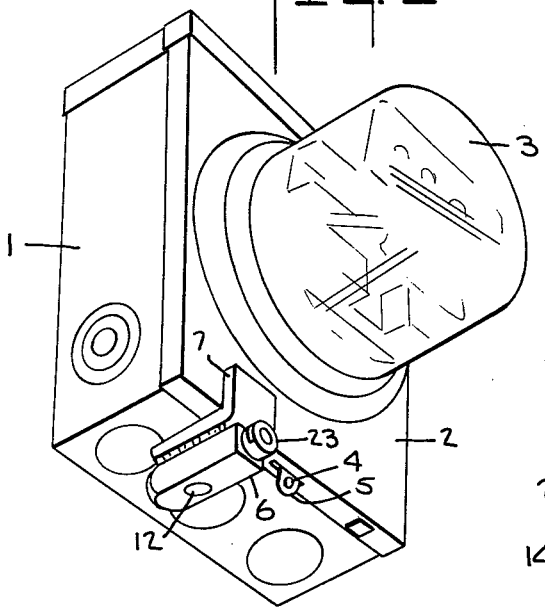
FIG. 1 is an isometric view of an electric meter mounted on a box having a cover held against opening by the lock of the invention.

FIG. 1 illustrates a connection box 1 having a cover 2 which is slidably received at its upper end by a portion of the box 1. A watthour meter 3 is mounted to the box 1 in a conventional manner so that the incoming electric power supply line and the consumer's equipment are made within the box 1. It has been customary to prevent unauthorized access to the interior of the box 1 by a seal or lock extending through the hole 4 in the tab 5 extending through a slot in the downturned edge portion of the cover 2. In place of such a seal or lock, the lock of the invention is employed with a body 6 having a bracket 7 secured thereto, such as by welding, to prevent opening of the cover 2.

Figure 2:
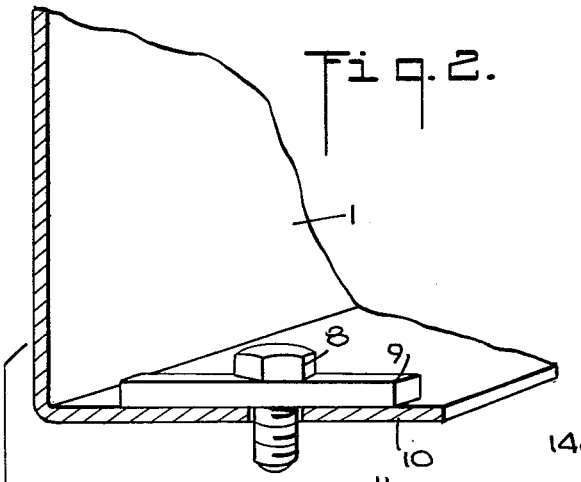
FIG. 2 is an enlarged, fragmentary, exploded view of a portion of the apparatus shown in FIG. 1.
Figure 2:
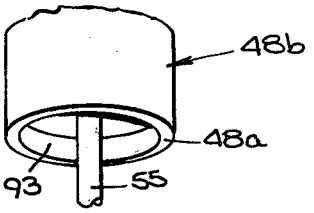
Figure 2:
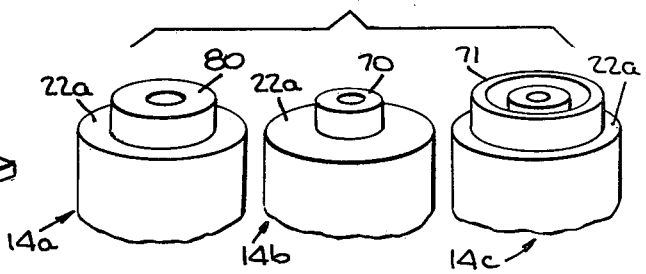

With reference to FIG. 2, the body 6 and the bracket 7 are held on the box 1 by a bolt 8 extending through a reinforcing plate or bar 9 and through a hole in the wall 10 of the box 1. The bolt 8 is threaded into a plate 11 secured to the head of a cylinder 12 having a through passageway 12*a* for the shank 13 of the lock 14 of the invention. The bracket 7 has a hole 15 and the body 6 has a passageway 16 for receiving the cylinder 12.

When the plate 11 and the cylinder 12 are secured to the wall 10, the cylinder 12 may be inserted into the passageway 16 with the passageway 12*a* aligned with the bore 17 of the body 6, and the lock 14 may be inserted into the bore 17 with the shank 13 of the lock 14 extending through the passageway 12*a*. The lock 14 has a pair of extensible locking members 18 which, when set by a tool 19 as described in said U.S. Pat. No. 4,040,279, seat in recesses 19*a* at the left end of the bore 17. When the locking members 18 have been seated in the recesses 18*a*, the lock 14 cannot be removed from the bore 17 without the proper key.

The body 6 has a recess 20 for receiving the head 21 of the lock 14 so that the exposed end 22 of the head 21 lies substantially flush with the right end surface of the body 6. A sleeve 23 may be secured to, or formed at, the right end of the body 6 to restrict access to the head 21 of the lock 14, and the sleeve 23 may have slots 24 for receiving the wire or tab of a conventional seal or padlock.

The lock 14 comprises the parts of the lock described in U.S. Pat. No. 4,155,232 modified to include the frangible pin described in U.S. Pat. No. 4,040,279 and used in connection with the installation of the lock 14. The lock 14 is also modified as described hereinafter to include means at its key receiving end 22 which prevents seating of an incorrect key so that the key is prevented from operating the lock 14, that is, prevented from releasing the extensible locking members 18 from the recesses 18*a* in the body 6.

The parts of the lock 14 common to the lock in U.S. Pat. No. 4,144,232 the operation thereof are described in detail in said U.S. Pat. No. 4,155,232 and reference is made to such patent for a detailed description of such parts and their functions. However, a general description of such parts and their functions will be set forth herein.

The generally cylindrical shank 13 of the lock 14 has an axial bore 30, one portion 31 of which is of reduced diameter to provide an internal shoulder 32, the keyhole 25 being narrower than the bore 39. Slidably fitted within the bore 30 are cylinder member 33 and piston 34.

The piston 34 and cylinder 33 constitute a compound plunger mechanism, the piston 34 having an elongated shaft portion 40 slidably received in a central axis bore 38 of the cylinder 33 and a piston head 41 of the same diameter as the cylinder 33 adjacent said piston head 41. The lock of the invention can only be opened by exerting force to hold the piston 34 in place while simultaneously retracting the cylinder 33 to open up a space into which the steel balls 18 can retreat to disengage from a cooperating groove or recess 18*a*. The lock 14 has an anti-tamper spring 43 pressing against the piston head 41 and has a tamper defeating element in the form of an eyelet 45 interposed between the cylinder 33 and the keyhole 25. The eyelet 45 is generally tubular, with an outwardly extending lip or flange 46 at the end of the eyelet 45 remote from the cylinder 33. The other end of the eyelet 45 normally abuts against the cylinder 33 surrounding a socket area 39 of the cylinder 33, which socket area must be engaged by the key for lock-opening withdrawal of the cylinder 33. It should be noted that axial length of the socket area 39 is small making it more difficult to engage the socket area 39 with an unauthorized key or fabricated picking tool.

A coiled locking spring 42*a* is compressed between the eyelet rim 46 and the head 21 of the lock, pushing the eyelet 45 and the cylinder 33 toward locked position. A second locking spring 42*b* is compressed between the lower side of the eyelet rim 46 and the cylinder 33. The eyelet 45 and springs 42*a* and 42*b* cooperate in thwarting tampering through the use of an unauthorized key. If an unauthorized key has been inserted in an attempt to open the lock, the key will fail to grip the socket area 39 and instead, will engage the eyelet 45 and partially withdraw the eyelet 45, leaving the cylinder 33 and the piston 34 in locking condition. The spring 42*b*, opening from its compressed state, will continue to depress the cylinder 33 as the eyelet 45 is retracted by the unauthorized key. Of course, an authorized key would be operative to open the lock by gripping the socket 39 and retracting the cylinder 33 and eyelet 45 while holding back the piston 34. Thus, the lock 14 is highly discriminating with respect to variations in key dimensions and depth of key insertion because of the limited depth and controlled diameter of socket 39, and controlled axial movement of fingers 28 by the internal collar of the key.

The lock 14 also has a frangible pin 47 which may, for example, be of plastic, graphite or aluminum and which is strong enough to resist the forces of the springs 42*a* and 42*b*, as well as shocks during shipping and handling. The pin 47 serves the same purposes as the frangible pin described in said U.S. Pat. No. 4,040,279 and can be broken by the application of force by the tool 19 when the lock 14 is installed. Therefore, it is unnecessary for the installer to have an authorized key for the lock 14 in order to install and lock the lock 14.

Figure 4:
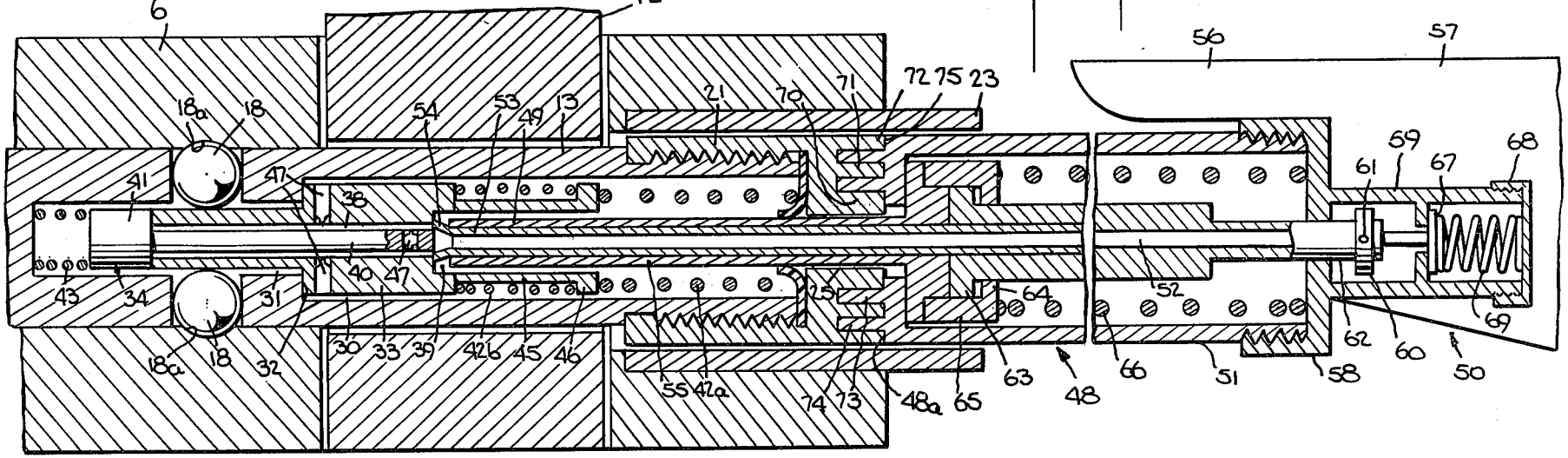
FIG. 4 is an enlarged, longitudinal, sectional view of the lock and key shown in the preceding figures with the key inserted in the lock.

The cylinder 33 is moved out of the way of the ball locking members 18 while the piston 34 is retained in the position shown in FIG. 4 by means of a key 48 in the manner described in said U.S. Pat. No. 4,155,232, most of the parts of the key 48 being the same as the parts of the key described in said U.S. Pat. No. 4,155,232. Reference is made to U.S. Pat. No. 4,155,232 for further details of the common parts and their functions, but a general description of the parts and functions will be set forth hereinafter.

The key 48 has a lever 56 and has a central rod-like member 52 for holding down the lock piston 34, closely yet slidably surrounded by a tubular sleeve 53 having a flared or bell-like end portion 54 for spreading the fingers 49 of the cylindrical member 55 which concentrically encompasses the sleeve 53 when the tubular sleeve 53 is drawn up between the fingers 49 and the central rod-like member 52 to engage the socket 39. The lever mechanism 50 is employed in cooperation with internal parts within the body 5 for quick operation.

The lever mechanism 50, has an elongated arm 56 for manipulation and a body portion formed with two parallel sides, only side 57 being visible in FIG. 4. Situated between the sides is a generally cylindrical housing 59, within which housing 59, a hex nut 60 is mounted to slide toward and away from the key cap 58 on a pair of pins 61 fitted in slots of the housing 59 and journalled in the sides for movement by the camming action of the lever 50. The nut 60 moves up and down as camming surfaces of the lever 50 engages the outer surface of the key cap 58, holding the lever 50 in its various operating positions. The nut 60 encircles a generally cylindrical element 62 secured to the tubular sleeve 53 and axially movable therewith. The member 62 has a stepped radially extending lip 63 for cooperation with inwardly extending lip 64 of a generally cylindrical collar 65 slidable axially within the key body 51. The mating lips 63 and 64 cause the elements 62 and 65 both to be biased away from the key cap 58 by the action of a coiled spring 66 under compression between the key cap 58 and the collar 65.

Movement of the lever arm 56 upwardly from the position of FIG. 4 brings the cylindrical element 62 axially upward, moving the lips 63 and 64 from a controlled spaced relationship into engagement, and also draws the tubular sleeve 53 toward the cap 58 against the opposition of the spring 66 so that the flared end 54 spreads apart the fingers 49 to engage the socket 39.

The controlled space or gap shown between the lips 63 and 64 in FIG. 4 wil be seen to be equal to the distance of the flared end 54 moves to spread the fingers into socket-engaging condition.

It will be seen that if the space or gap between the lips 63 and 64 were smaller than the controlled space distance shown in FIG. 4, the spreading of the fingers 49 by the flared end 54 would be reduced or limited accordingly. If the preset space between the lips 63 and 64 were increased the flared end 54 would be drawn up further between the fingers 49. Thus by selection of the spacing of the lips 63 and 64 in the key condition of FIG. 4, the key can be dimensioned to engage a socket 39 of selected diameter, and will not engage a larger diameter socket 39. Furthermore, due to the limited height of the socket 39 and the critical positioning of the member 55 required in order to cause its fingers 49 to engage the socket 39 rather than the eyelet 45, the depth to which the member 55 penetrates into the lock 14 is critical. In other words if the seating face 48*a* of the key 48 cannot engage the seating face or exposed end 22 of the lock 14, within close limits, the member 55 will not move the cylinder 33 to a position which permits the balls 18 to retract.

The split cylinder 55 which constitutes the fingers 49 is also movable in the upward direction. The central rod-like member 52 extends slidably centrally through the members 53 and 62 to protrude above the end of the member 62 and nut 60 at the lever 50. The central member 52 terminates at its outer end in a disc-like head 67 closely slidable within the cylindrical housing 59. Between this head 67 and a cap 68 of the housing 59 there is provided a coiled relief spring 69, serving to allow some degree of retraction of the central rod-like member 52. This relief spring 69 prevents damage to the rod-like member 52 when the end thereof forcibly abuts against the piston 40 of the lock, or is jammed against foreign matter in a lock.

In accordance with the invention, the ends of the key 48 and the lock 14 which face each other when the key 48 is inserted in the lock 14 are provided with cooperating, shaped means which permit a correct key 48 to be inserted to a depth within the lock 14 which, when the arm 56 is raised, will cause the fingers 49 of the member 55 to engage the wall of the socket 39 and thereby raise the cylinder 33 without raising the piston 34, whereby the balls 18 are permitted to retract and the lock 14 may be removed from the body 6. However, when an attempt is made to open the lock 14 with an incorrect key 48 which has means thereon which does not mate with the shaped means at the end of the lock 14 and the key 48 is thereby prevented from being inserted to the proper depth in the lock 14, the fingers 49 of the member 55 cannot grip the wall of the socket 39.

FIGS. 4–25 illustrate various shaped means which may be employed at the end 22 of the lock 14. In FIG. 4, the lock 14 has three annular rings 70, 71 and 72 at its end 22 which is engaged by the end of the body 51 of the key 48. The rings 70–72 are of different diameters and are spaced apart to provide two recesses therebetween for receiving a pair of spaced rings 73 and 74 on the end of the body 51. The rings 70–72 may be integral with or securely affixed to the lock 14, and the rings 73 and 74 may be integral with or securely affixed to the key 48.

As previously mentioned, the distance between the seating face 48*a* and the lower end of the member 55 is critical to the release of the balls 18. Thus, such distance must be the same, within narrow limits, as the distance between the upper or seating face 75 of the lock 14, which is formed by the upper ends of the rings 70–72, and the wall of the socket 39 if the member 55 is to be in a position which permits its fingers 49 to engage the wall of the socket 39 when the arm 56 is raised. Of course, if desired, the lower ends of the rings 73 and 74 may seat against the bottoms of the recesses between the rings 70 and 71 and the rings 71 and 72 rather than having the face 48*a* a seat against the face 75. However, in this latter event, the distance between the lower ends of the rings 73 and 74 and the lower end of the member 55 is similarly critical.

The axial dimensions of the rings 70–74 preferably are selected so that if the key 48 has a ring or rings 73 and 74 which do not mate with recesses on the end of the lock 14 or if the lock 14 has a ring or rings 70–72 which do not mate with corresponding recesses at the lower end of the key 48, the member 55 cannot be inserted far enough into the lock 14 to permit the fingers 49 to grip the wall of the socket 39 when the arm 56 is raised. In other words, the distance between the seating face of the key 49 and the lower end of the member 55 must be substantially equal to the distance between the seating face of the lock 14 and the socket 39 when the lower end of the key 48 is seated axially on the seating face of the lock 14 in order for the key 48 to release the balls 18. If the rings 70–74 do not intermesh and an end surface a ring 73 or 74 engages an end surface of a ring 70–72, then the seating faces of the key 48 and the lock 14 cannot engage and the lower ends of the fingers 49 of the member 55 cannot engage the wall of the socket 39. In this way, except for master keys described hereinafter, the lock 14 can be opened only by a key 48 having the correct end configuration.

Of course, it will be apparent that if a key 48 having a plane lower end face, that is, the rings 73 and 74 are removed, were available, such a key 48 would fit any lock 14 with a ring or rings 70–72 of the same height as those which are on a lock 14 which will accept the key 48 having a member 55 of the proper length. Thus, such a key with the plane face would be a master key for locks 14 with one or more such rings 70–72. However, such a master key would either not be made available or would be available on only a highly restricted basis.

Figure 5:
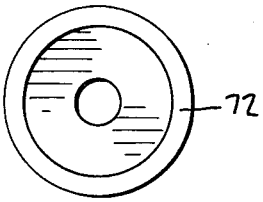
FIGS. 5–22 are end views of the lock illustrating various configurations of the lock end which may be employed in the invention.
Figure 6:
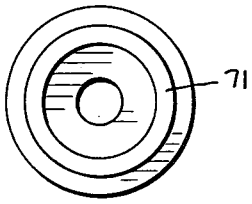
Figure 7:
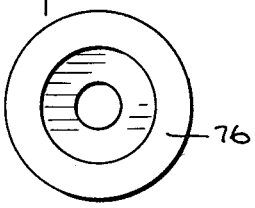
Figure 8:
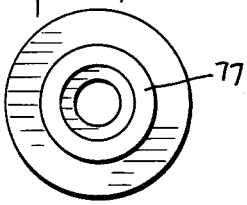
Figure 9:
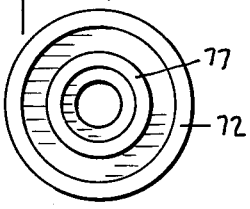
Figure 10:
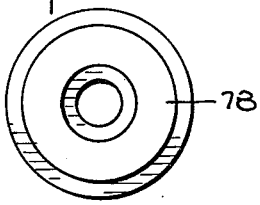
Figure 11:
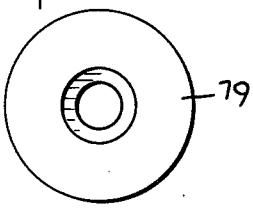
Figure 12:
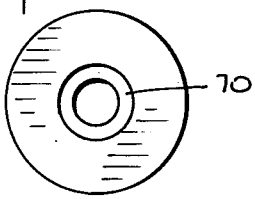
Figure 13:
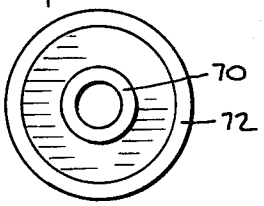
Figure 14:
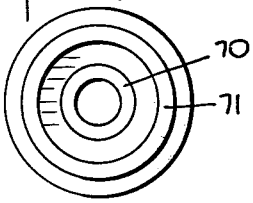
Figure 15:
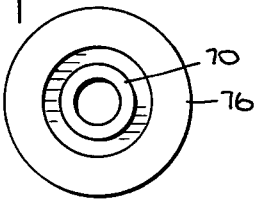
Figure 16:
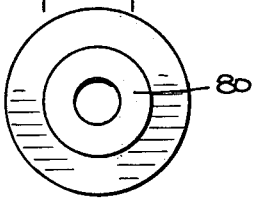
Figure 17:
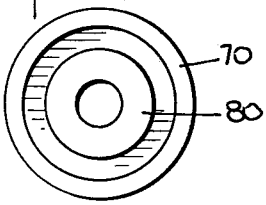
Figure 18:
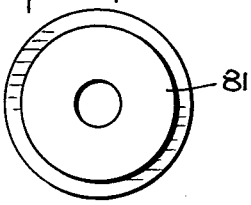
Figure 19:
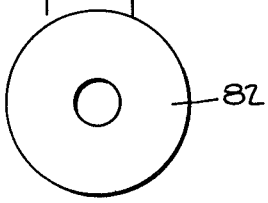

FIGS. 5–19 illustrate various ring arrangements for the ends of locks 14 which may be used, the ends of the matching keys 48 being shaped in an obvious manner to mate with the lock ends. FIG. 5 illustrates a single outer ring 72, FIG. 6 illustrates a single middle ring 71 and FIG. 7 illustrates a single, relatively thick outer ring 76. FIG. 8 illustrates a relatively thin, intermediate ring 77, FIG. 9 illustrates the addition of the outer ring 72 and FIG. 10 illustrates a relatively thick intermediate ring 78. FIGS. 11, 12 and 13 respectively illustrate a relatively thick, outer ring 79, a single central ring 70 and central and outer rings 70 and 72. FIGS. 14, 15 and 16 respectively illustrate central and intermediate rings 70 and 71, a central ring 70 with a relatively thick outer ring 76 and a relatively thick central ring 80. FIGS. 17, 18 and 19 respectively illustrate a combination of rings 72 and 80, a relatively thick central ring 81 and a plane end face 82, the latter, in effect, being a single ring covering the end face of the lock 14.

Figure 20:
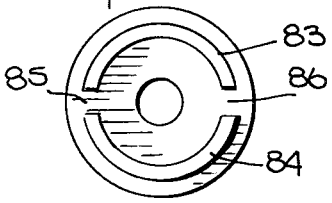
Figure 21:
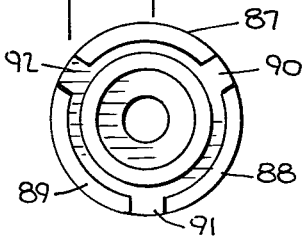

It will be apparent from FIGS. 4–19 that by the mere use of different rings or numbers of rings on the end face of the lock 14, sixteen locks requiring sixteen different individual keys 48 can be provided. Of course, it will be apparent that a greater number can be provided by varying ring dimensions, etc. Further locks 14 requiring corresponding individual keys 48 can be provided by using ring segments as illustrated in FIGS. 20 and 21, and providing keys 48 having end projections which fit into the gaps between the segments. FIG. 20 illustrates a pair of arcuate segments 83 and 84 with gaps 85 and 86, and FIG. 21 illustrates on three outer segments 87, 88 and 89 with intermediate gaps 90, 91 and 92.

Figure 22:
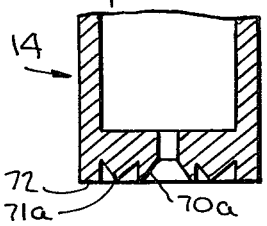

In addition, further locks 14 requiring corresponding individual keys 48 can be provided by shaping the cross-section of the rings at the end of the lock as illustrated in FIG. 22. Thus, FIG. 22 illustrates the outer ring 72 with central and intermediate rings 71*a* and 70*a* respectively which have saw-tooth, rather than rectangular cross-sections.

Figure 23:
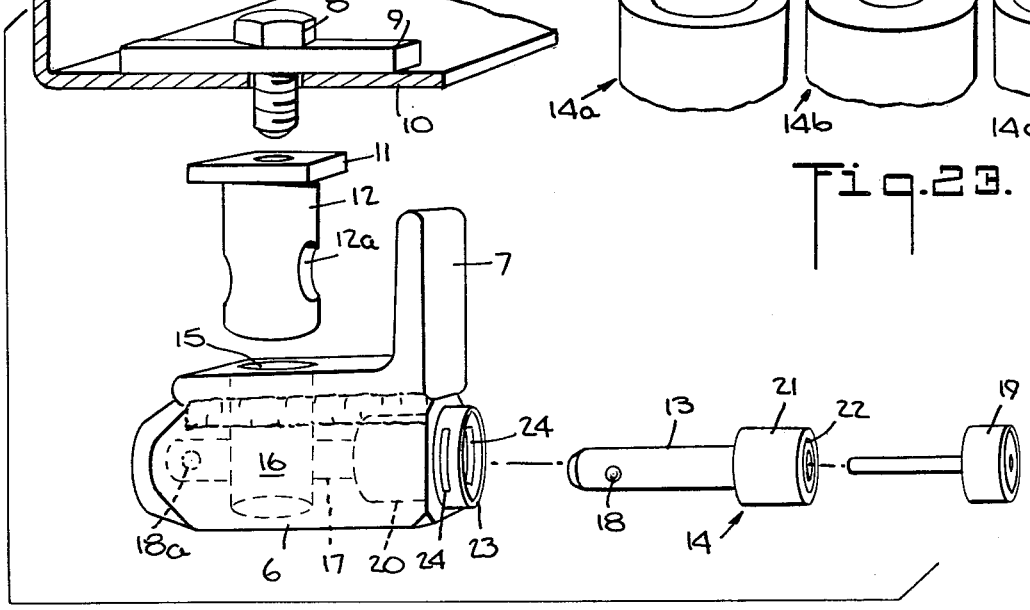
FIG. 23 illustrates the end of a master key which may be used with locks having the various end configurations shown in FIG. 23.
Figure 3:
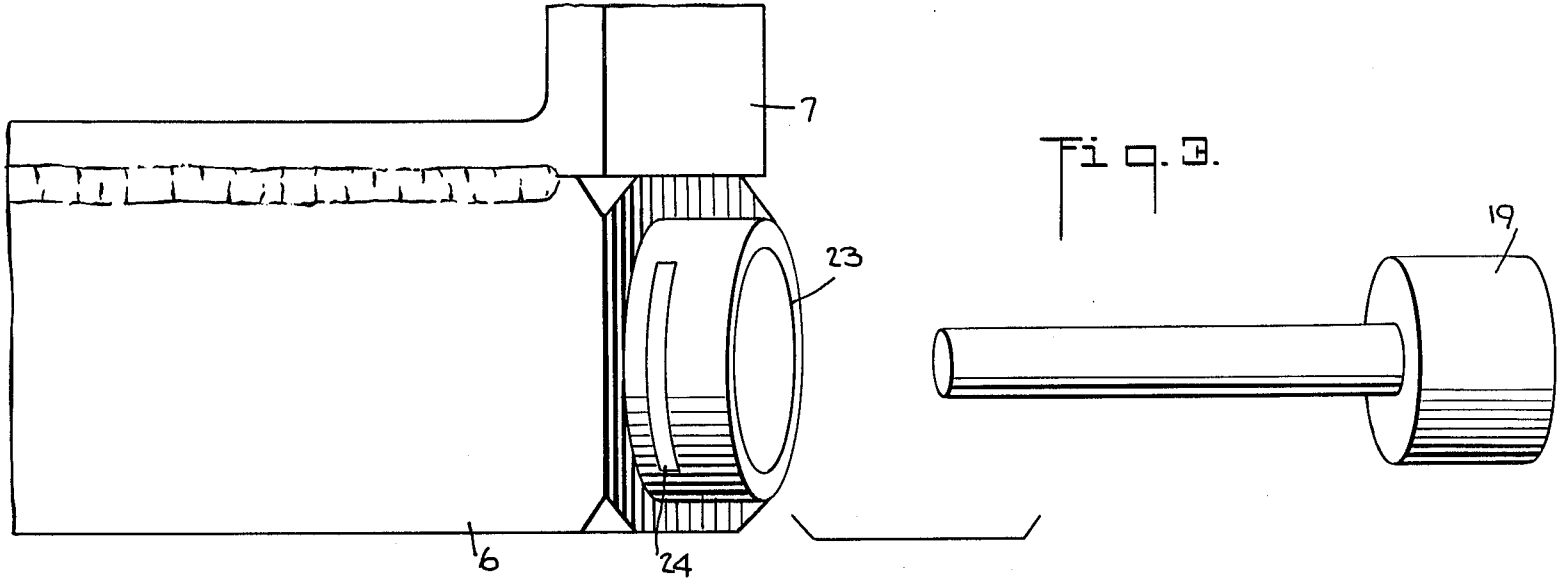
FIG. 3 is an enlarged, side elevation view of a portion of the apparatus shown in FIG. 2.

FIG. 23 illustrates a master key 48*b* for the locks illustrated in FIGS. 16, 12 and 6. The end of the key 48*b* has a seating surface 48*a* which will engage with the seating surface 22*a* of the locks 14*a*, 14*b* and 14*c* and has a recess 93 for receiving each of the rings 80, 70 and 71. Accordingly, when the surface 48*a* engages the surface 22*a*, the member 55 will be properly positioned within the locks 14*a*, 14*b* or 14*c* and may be operated to release the balls 18.

It will also be apparent to those skilled in the art that if the axial lengths of the rings in the locks shown in FIGS. 4–22 are all the same, a key 14 with a plane end surface 22 and a member 55 and associated rod 52 and sleeve 53 which are longer than the member 55, etc. illustrated in FIG. 4 by the axial length of the rings on the various locks can be used as a master key for all the locks illustrated in FIGS. 4–22.

Figure 24:
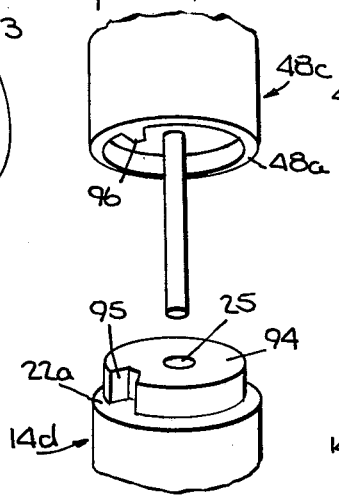
FIGS. 24 and 25 illustrate further lock end configurations and the ends of keys which may be used therewith.
Figure 25:
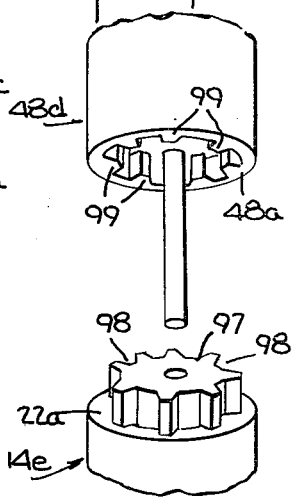

FIGS. 24 and 25 illustrate alternate configurations of the lock end and the key end which may be employed to prevent a key having an incorrect end configuration from being properly positioned in a lock. In FIG. 24 the lock 14*d* has a relatively thick ring 94 around the opening 25 of the lock 14*d*, and the ring 94 has a peripheral notch or groove 95. The key 48*c* will fit the lock 14*d* but will not fit a lock with a larger diameter ring 94 or with a ring 94 without a notch 95 which will not receive the radial projection 96 at the end of the key 48*c*. FIG. 25 is similar to FIG. 24 but shows a lock 14*e* with a ring 97 having a plurality of notches 98 and a key 48*d* with a plurality of radial projections 99 which fit into the notches 98.

From the foregoing it will be apparent that many different locks with substantially the same structure but with differently shaped means at their key receiving ends and a plurality of keys, each of which will fit only one of the locks, can be easily provided. Also, master keys which will fit all, or only a plurality of such locks, can also be provided.

Although preferred embodiments of the present invention have been described and illustrated, it will be apparent to those skilled in the art that various modifications may be made without departing from the principles of the invention.

What is claimed is:

1. A plunger-type lock having an elongated body with a central, longitudinally extending bore, extensible locking members movable inwardly and outwardly of said body, key-operable plunger means reciprocable longitudinally of said bore for alternately locking said locking members outwardly of said body and permitting said locking members to move inwardly of said body, said body having a key seating face at one end of said bore which faces away from said plunger means and which is exposed at the exterior of said body, said face being at a predetermined distance from a portion of said plunger when the latter is in the position thereof which locks said members outwardly of said body, whereby a key having a plunger means operating portion spaced said predetermined distance from the portion thereof which engages said face can engage said portion of said plunger and move said plunger means longitudinally of said bore, and shaped means on said body and extending from said face for engaging a surface of a key and preventing seating on said face of said last-mentioned key when said last-mentioned key has a configuration which prevents receipt of said shaped means therein.

2. A plunger type lock as set forth in claim 1 wherein said shaped means comprises at least one ring on said face which extends axially away from said face and in a direction away from said plunger means.

3. A plunger type lock as set forth in claim 2 wherein said shaped means comprises a plurality of rings on said face each of which rings extends axially away from said face and in a direction away from said plunger means, said rings being concentric and spaced from each other.

4. A plunger type lock as set forth in claim 1 or 2 wherein at least one said ring has a rectangular cross-section.

5. A plunger type lock as set forth in claim 1 or 2 wherein at least one said ring has a cross-section other than rectangular.

6. A plunger type lock as set forth in claim 1 wherein said shaped means comprises a projection extending away from said face and in the direction away from said plunger means.

7. A plunger type lock as set forth in claim 6 wherein said projection is a ring having at least one notch therein.

8. A plunger type lock as set forth in claim 6 wherein said projection is arcuate and extends around the longitudinal axis of said body.

9. A plunger type lock as set forth in claim 7 wherein there are a plurality of the arcuate projections, said projections being disposed with gaps intermediate their ends.

10. A key for a plunger type lock having an exterior key seating face which is exposed at the exterior of said lock, shaped means extending from said face, and a key operable member spaced a predetermined distance from said face, said key comprising an elongated body, a rod-like member extending from one end of said body, expansible means at the end of said rod-like member remote from said end of said body, and means on said body for expanding said expansible means, said end of said body having a face for engaging said key seating face on said lock for positioning said expansible means with respect to said operable member of said lock, and said body having means at said face thereof for receiving said shaped means and thereby permitting said face of said key body to engage said key seating face on said lock.

11. A key as set forth in claim 10 wherein said means at said end of said key body for receiving said shaped means comprises at least one projection at said end extending above other portions of said end and defining at least a portion of a recess for receiving said shaped means.

12. A key as set forth in claim 11 wherein said projection is a ring.

13. A key as set forth in claim 11 wherein there are a plurality of the projections, each projection having the shape of ring and each ring being concentric with and spaced from each other ring.

14. A key as set forth in claim 13 wherein at least one ring has a rectangular cross-section.

15. A key as set forth in claim 13 wherein at least one ring has a cross-section other than rectangular.

16. A key as set forth in claim 11 wherein said projection comprises a ring with a further projection extending radially inwardly from said last-mentioned ring.

17. In combination a plunger type lock having an elongated lock body with a central, longitudinally extending bore, extensible locking members movable inwardly and outwardly of said body, key-operable plunger means reciprocable longitudinally of said bore for alternately locking said locking members outwardly of said body and permitting said locking members to move inwardly of said body, said body having a key seating face at one end of said bore which faces away from said plunger means and which is exposed at the exterior of said body, said face being at a predetermined distance from a portion of said plunger when the latter is in the position thereof which locks said members outwardly of said body, a key comprising an elongated key body, a rod-like member extending from one end of said key body, expansible means at the end of said rod-like member remote from said end of said key body for engaging said portion of said plunger, and means on said key body for expanding said expansible means, said end of said key body having a face for engaging said key seating face on said lock for positioning said expansible means with respect to said operable member of said lock and said expansible means being spaced from said face of said key body by a distance which is substantially equal to said predetermined distance whereby engagement of said face of said key body with said key seating face positions said expansible means so that it can engage said portion of said plunger, said lock body having shaped means extending from said face of said lock body and said key body having means at said end thereof for receiving said shaped means and permitting said face of said key to engage said key seating face.

18. The combination as set forth in claim 17 wherein said shaped means comprises at least one projection extending away from said key seating face and in the direction away from said plunger means and wherein said means at said end of said key body comprises means defining a recess for receiving said projection.

19. The combination as set forth in claim 18 wherein said projection comprises a ring and said means defining a recess is at least one further ring dimensioned to fit adjacent said first-mentioned ring.

20. The combination as set forth in claim 18 wherein there are a plurality of the projections, each projection having the shape of a ring and each last-mentioned ring being concentric with and spaced from each other last-mentioned ring and wherein said means defining a recess comprises a plurality of spaced further rings for receiving the projections therebetween.

21. The combination as set forth in claim 20 wherein at least one ring has a rectangular cross-section.

22. The combination as set forth in claim 20 wherein at least one ring has a cross-section other than rectangular.

23. The combination as set forth in claim 18 wherein said means defining a recess comprises a ring with at least one further projection extending radially inwardly from said last-mentioned ring and wherein said first-mentioned projection has a recess for receiving said further projection.

* * * * *